US005216972A

United States Patent [19]

Dufrene et al.

[11] Patent Number: 5,216,972

[45] Date of Patent: Jun. 8, 1993

[54] LIGHTED CLEAT

[76] Inventors: John K. Dufrene, 21121 Shepard La.; John Deed, 21542 Newland St., both of Huntington Beach, Calif. 92646

[21] Appl. No.: 755,810

[22] Filed: Sep. 6, 1991

[51] Int. Cl.[5] ..... B63B 21/06

[52] U.S. Cl. ..... 114/218; 24/115 J; 428/160; 136/291; 362/61; 362/391

[58] Field of Search ..... 24/115 J, 115 R, 129 R, 24/129 B; 114/218, 381; D8/356; 428/160; 441/16; 315/77; 362/61, 64, 83.3, 391

[56] References Cited

U.S. PATENT DOCUMENTS

| | | | |
|---|---|---|---|
| 1,668,544 | 5/1928 | Armstrong | 114/218 |
| 1,852,260 | 4/1932 | Perkins | 114/218 |
| 3,291,094 | 12/1966 | Beebe | 114/218 |
| 3,730,129 | 5/1973 | Helms | 114/218 |
| 3,828,714 | 8/1974 | Perkins | 114/218 |
| 3,897,745 | 8/1975 | Hutchings | 114/218 |
| 4,173,144 | 11/1979 | McLaughlin | 114/218 |
| 4,353,319 | 10/1982 | Ash | 114/218 |
| 4,414,910 | 11/1983 | Renton | 114/218 |
| 4,759,735 | 7/1988 | Pagnol | 114/16 |
| 4,845,597 | 7/1989 | McCaghren | 114/218 |
| 5,066,338 | 11/1991 | Meyers | 441/16 |

*Primary Examiner*—Joseph F. Peters, Jr.
*Assistant Examiner*—Clifford T. Bartz
*Attorney, Agent, or Firm*—Beech & Collins

[57] ABSTRACT

A device which is a translucent boat or ship cleat constructed of polyurethane. The cleat is molded as one piece and can be either clear or have color added such as international orange. The cleat has a recess in its base in which a light source can be placed. Lighting such as incandescent, neon or LED may be used. The cleat can be powered from an external source either AC or DC. The cleat can also have solar cells placed in its horns which can store energy in storage cells mounted with the cleat at its base for powering LED during non-sunlight hours. The illuminated cleat makes it easy to locate the mooring for a boat in the dark. It also makes the cleat visible for the safety of persons walking on the mooring structure. The polyurethane construction provides for a lighter, more durable, and less abrasive device fo boat moorings.

1 Claim, 4 Drawing Sheets

LIGHTED CLEAT

FIELD OF THE INVENTION

This invention relates to devices used to secure boats to moorings. More specifically, the instant device is an improvement of cleats used on boat docks and other mooring structures for wrapping and tying boat ropes to secure the boat to the dock.

DESCRIPTION OF RELATED ART

There are currently in use many variations of clamps or cleats for use in wrapping and tying boat ropes to secure or moor boats to structures such as boat docks. These devices have typically been made of wood, pot metal, cast iron or aluminum. Use of plastics has also been considered as for example in U.S. Pat. No. 3,828,714. Nylon and plastic cleats use ultraviolet inhibitors which allow black or white cleats, but they are not translucent. They are opaque in nature and don't stand out in daylight nor can they be lighted internally.

The cleat usually has a fairly standard shape consisting of some form of pedestal to stand the upper portion some distance off the structure to which it is anchored. The upper or top portion to which a rope is normally wrapped and fastened has the appearance of horns as found on horned animals although in the case of a cleat the two protrusions are straight relative to the pedestal with a slight up turn of the horn ends relative to the dock or structure. Such cleats can be less than a foot long up to many feet long for much larger ships.

The present invention combines the use of illuminating the cleat for easy visibility in reduced light situations with the idea of a cleat constructed of polyurethane. Constructing the cleat of polyurethane allows for a light weight device that is translucent and can be clear or colored with various colors. This allows the effect of sunlight to make the cleat very visible. A light source can then be placed in the structure, usually the base, that then illuminates the polyurethane cleat making it visible for distances in the range of 1000 yards or greater depending on conditions. This provides a means for easy location of mooring points for boats and safety for those walking on the dock or structure during day or night due to color and translucense. The coloring may also be used at identify a particular mooring as to its use or to signal a time limit for mooring.

SUMMARY OF THE INVENTION

A primary objective of the present invention is to provide ease of visibility of mooring cleats for boats during reduced light conditions. By providing a transluscent cleat with a light source contained in its structure, the cleat becomes visible to locate the mooring point for boats and to provide safety for persons walking on docks and other structures such that they do not trip over the cleat.

A further object of the invention is to provide a light weight cleat. More common cleats constructed of pot metal or cast iron typically weigh seven pounds or more for smaller boat cleats. The same size polyurethane cleat weighs little more than a pound. Another object of the invention is to provide a more durable, non-toxic and non-abrasive mooring device. The polyurethane cleat is not for example hot dip galvanized such as metal cleats. In addition, the finished surface of the cleat is not as coarse or abrasive as a metal cleat thus producing less wear on ropes attached to it. The polyurethane is more durable when exposed to environmental elements, particular sea water. Existing cleats, except for plastic, are required to be painted where such paint is continually under wear from the elements thus requiring refurbishment.

A further object of the invention is to provide a cleat that can be of a color to provide warning of its location for either safety on a dock or for boat mooring. Although more traditional cleats may be painted, the polyurethane cleat can be colored such as yellow or international orange during its molding process such that the entire structure is of the same color.

In accordance with the description presented herein other objects of this invention will become apparent when the description and drawings are reviewed.

DESCRIPTION OF THE PREFERRED EMBODIMENT

The lighted cleat consists of a cleat formed from a clear or colored translucent polyurethane material including liquid ultraviolet inhibitors for color durability. The cleat has an aperture in its structure, usually the base, into which a light source may be placed. The power source for the light source can be external DC such as a battery or AC such as dock power. In addition, the cleat can be equipped to use the sun to charge a battery to power the light source during non-daylight hours. When the light source is on, it illuminates the entire structure of the cleat making it visible during darkened conditions.

Figure 2:
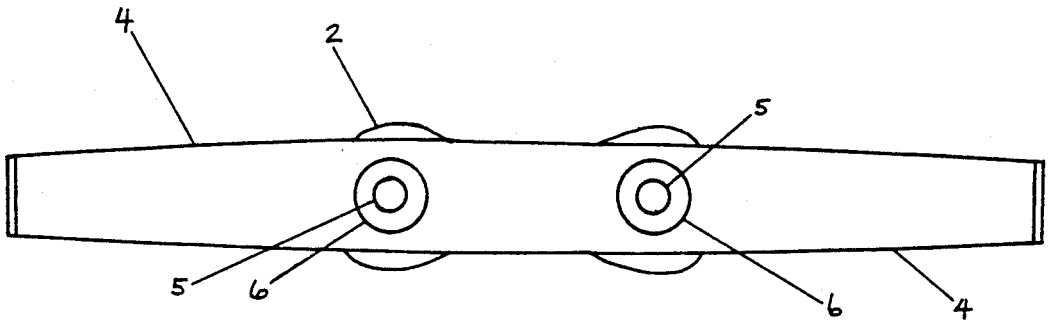
FIG. 2 illustrates a top view of the cleat.
Figure 1:
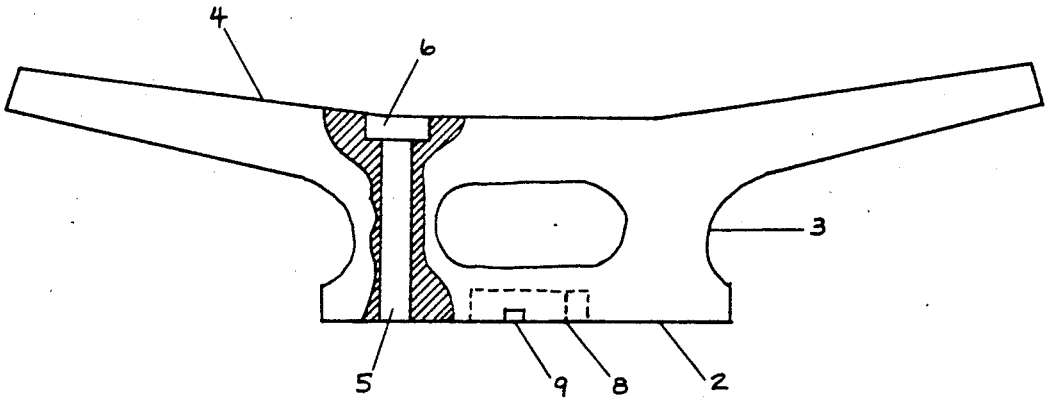
FIG. 1 illustrates a side view of the cleat.
Figure 3:
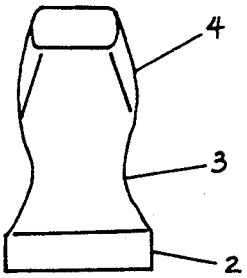
FIG. 3 illustrates an end view of the cleat.
Figure 4:
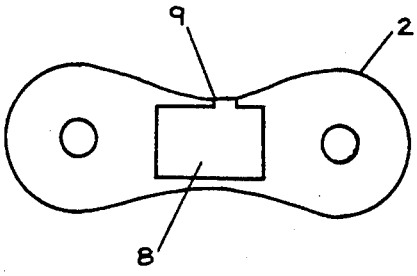
FIG. 4 illustrates a bottom view of the cleat and the aperture for an illuminating source.
Figure 5:
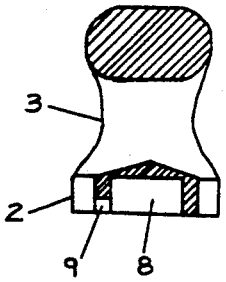
FIG. 5 illustrates a cross section of the cleat indicating the aperture for an illuminating source.

Referring to FIGS. 1 through 5, a single molded piece polyurethane cleat (1) consists of a base (2) having two pedestals (3) with two horns (4) on top thereof. The base (2), pedestals (3) and horns (4) have a fastening aperture (5) defined therein which is a cylindrical shape to allow a fastener such as a bolt (7) to pass through to anchor or fasten the cleat (1) to a structure such as a dock. The horn (4) end of the fastener aperture (5) is counter sunk with a larger diameter cylinder counter aperture (6) to allow the head of the fastener such as a bolt (7) head to fit into the horn (5) and not protrude above the surface once installed. The horns (4) are normally tipped upward from the horizontal surface to which the cleat (1) is attached as illustrated in FIG. 1. Many compositions of polyurethane are known in the art and a suitable strength composition should be chosen to construct a structurally sound cleat (1).

It has been found that a polyurethane resulting from the reaction of any polyfunctional isocyanate including, but not limited to, toluenediisocyanate (TDI) its derivatives and isomers and their prepolymers, and diphenylenemethanediisocyanate (MDI) its derivatives and isomers and their prepolymers, with any polyfunctional alcohol (polyol) including, but not limited to, those containing polyester, polyether, and polyunsaturated backbones, or any polyamine including, but not limited to 4,4'methylenebis (20-chloroaniline) its derivatives and isomers.

The cleat (1) has a light source aperture (8) defined in the base (2). The base (2) further has an access aperture (9) defined in one side thereof of the light source aperture (8) to allow a power source to be connected to a light source (10) that is placed in the light source aperture (8).

Figure 6:
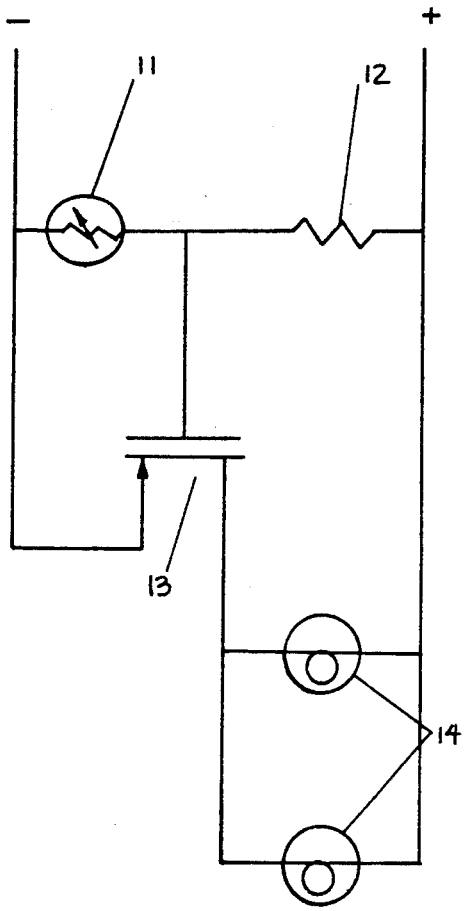
FIG. 6 illustrates a schematic for a DC supplied incandescent light source.
Figure 8:
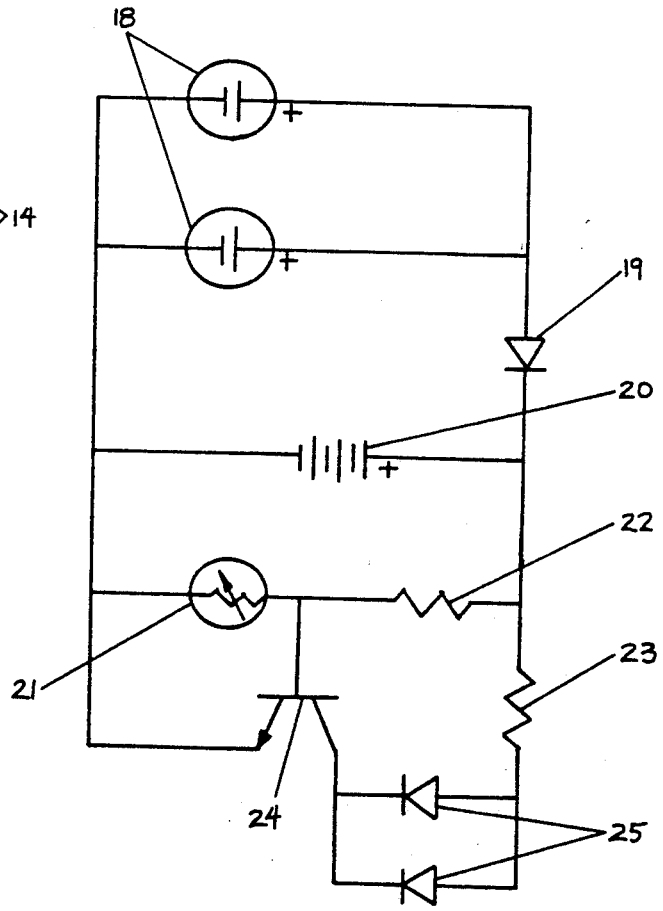
FIG. 8 illustrates a schematic for a solar powered light emitting diode light source.
Figure 7:
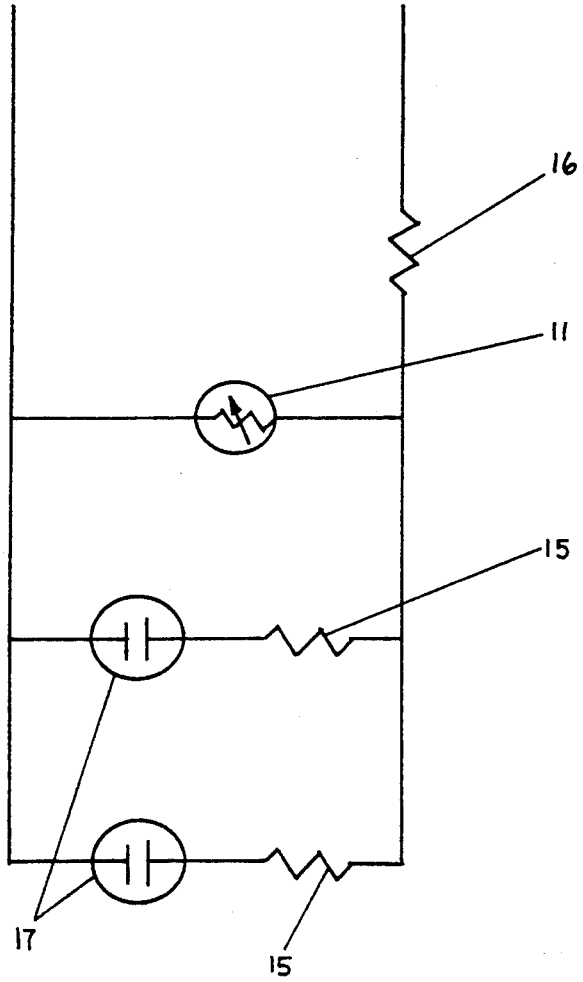
FIG. 7 illustrates a schematic for a AC supplied neon light source.

Referring to FIGS. 6 through 8, typical schematics for representative light sources are illustrated. In FIG. 6, by choosing suitable values for the photoresistor (11), resistor (12) and transistor (13), incandescent lamps (14) may be powered from a DC power source such as a battery, DC generator or transformer at a particular voltage such as 11-13VCD or 22-26VDC.

Referring to FIG. 7, again by suitable selection of component values for the photoresistor (11), resistors (15) and resistor (16), neon lamps (17) may be powered by a 117 VAC power source.

If a self contained cleat (1) is desired, that is, one which does not require remote power or continual replacement of batteries, then solar cells may be used. As shown in FIG. 8, by choosing suitable solar cells (18), diode (19), storage cells (20), photoresistor (21), resistors (22) and (23), transistor (24) and light emitting diodes (LED) (25), the cleat (1) may be illuminated by the LED (25). By locating the solar cells (18) near the tips (26) of the horns (4) in the solar apertures (27) oriented up toward the sun, the solar cells (18) get maximum exposure to the sun. The solar cells (18) are then connected via channels (28) with wires to storage cells (20) mounted below the base (2). When the sun is present, energy is stored in the storage cells (20), during periods of darkness the LED (25) can be powered from this stored energy.

Figure 9:
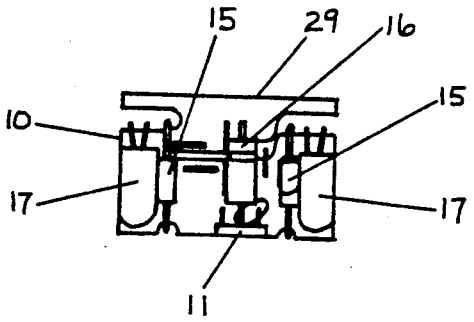
FIG. 9 illustrates a typical component layout for the light source to be placed in the cleat light source aperture.
Figure 10:
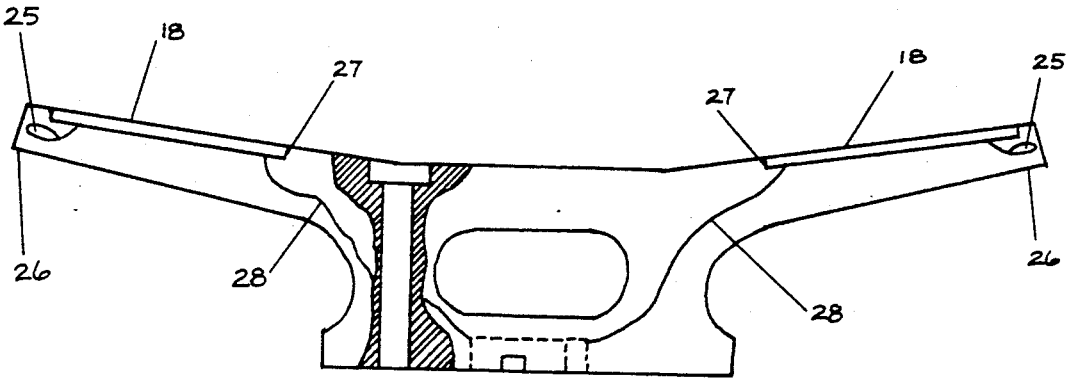
FIG. 10 illustrates a cleat with solar cells and lights in the horns.

Referring to FIG. 9 there is a typical circuit board (29) layout for the light source (10) illustrating neon lamps (17), resistor (16), resistors (15) and photoresistor (11).

I claim:

1. A cleat for mooring of boats or ships comprising: a base having a pedestal mounted thereon which pedestal has two horns attached opposite the base with such horns of suitable length for attaching a rope thereto; wherein the base, the pedestal and the horns have a fastener aperture defined therein; the cleat is constructed of uniform composition translucent polyurethane wherein there is a light source aperture defined in the base and an access aperture defined in the base; and the horns have a solar cell aperture defined therein such that a solar cell is connected to a storage cell which storage cell is connected to a light source in the light source aperture.

* * * * *